US010767480B2

(12) United States Patent
Zhang et al.

(10) Patent No.: US 10,767,480 B2
(45) Date of Patent: Sep. 8, 2020

(54) EXTENSIBLE REAMING SELF-ANCHORING ANCHOR ROD AND SUPPORTING METHOD THEREOF

(71) Applicant: CHINA UNIVERSITY OF MINING AND TECHNOLOGY, Xuzhou, Jiangsu (CN)

(72) Inventors: Nong Zhang, Jiangsu (CN); Peng Ma, Jiangsu (CN); Changliang Han, Jiangsu (CN); Zhengzheng Xie, Jiangsu (CN)

(73) Assignee: CHINA UNIVERSITY OF MINING AND TECHNOLOGY (CN)

( * ) Notice: Subject to any disclaimer, the term of this patent is extended or adjusted under 35 U.S.C. 154(b) by 0 days.

(21) Appl. No.: 15/751,808

(22) PCT Filed: Jun. 7, 2017

(86) PCT No.: PCT/CN2017/087492
§ 371 (c)(1),
(2) Date: Feb. 9, 2018

(87) PCT Pub. No.: WO2018/095012
PCT Pub. Date: May 31, 2018

(65) Prior Publication Data

US 2020/0217201 A1 Jul. 9, 2020

(30) Foreign Application Priority Data

Nov. 25, 2016 (CN) ..... 2016 1 1059159

(51) Int. Cl.
*E21D 21/00* (2006.01)
*E21D 20/00* (2006.01)
(Continued)

(52) U.S. Cl.
CPC ..... *E21D 21/0026* (2013.01); *E21D 20/003* (2013.01); *E02D 5/74* (2013.01);
(Continued)

(58) Field of Classification Search
CPC combination set(s) only.
See application file for complete search history.

(56) References Cited

U.S. PATENT DOCUMENTS 5,169,256 A * 12/1992 Woodings ..... E21B 17/0426 285/390
10,024,019 B1 * 7/2018 Hunter ..... E02D 7/22
(Continued)

FOREIGN PATENT DOCUMENTS

AU 2015201268 4/2015 ..... E21D 21/00
CN 101802420 8/2010 ..... E04B 1/48
(Continued)

*Primary Examiner* — Kyle Armstrong
(74) *Attorney, Agent, or Firm* — Hayes Soloway P.C.

(57) ABSTRACT

Provided is a mounting method for an extensible reaming self-anchoring anchor rod, which is especially applicable to roadway construction in coal mines. A big helical structure is arranged on two rod sections of a sectional type anchor rod, a simple drill bit drills and reams a bore and cuts the coal mass in one operation, the outer diameter of the simple drill bit is smaller than the outer diameter of the big helical rod body, and the big helical structure accomplishes secondary reaming, self-drilling and self-anchoring in the drilling process; the big helical structure inhibits propagation and development of sheet cracks of the coal wall in the radial direction, and is embedded in the coal mass through a self-stabilization process of the rock mass.

9 Claims, 1 Drawing Sheet

(51) Int. Cl.
*E02D 5/74* (2006.01)
*E21D 20/02* (2006.01)

(52) U.S. Cl.
CPC ..... *E21D 20/021* (2013.01); *E21D 21/008* (2013.01); *E21D 21/0093* (2013.01)

(56) References Cited

U.S. PATENT DOCUMENTS

| | | | | |
|---|---|---|---|---|
| 2011/0131787 | A1 | 6/2011 | Moroney et al. | 29/522.1 |
| 2015/0345098 | A1* | 12/2015 | Song | E02D 5/56 405/252.1 |

FOREIGN PATENT DOCUMENTS

| | | | |
|---|---|---|---|
| CN | 102704969 | 10/2012 | E21D 21/00 |
| CN | 105888709 | 8/2016 | E21D 21/00 |
| CN | 106368725 | 2/2017 | E21D 20/00 |
| WO | WO2016123668 | 8/2016 | E21D 21/00 |

* cited by examiner

A-A

B-B

EXTENSIBLE REAMING SELF-ANCHORING ANCHOR ROD AND SUPPORTING METHOD THEREOF

I. TECHNICAL FIELD

The present invention relates to an anchor rod and a supporting method, in particular to a supporting method of an extensible reaming self-anchoring anchor rod used for control of coal roadway sides and quick tunneling in the field of roadway supporting in coal mines.

II. BACKGROUND ART

Anchor rod supporting is a main coal roadway supporting method. At present, the two sides of coal roadway are supported with a resin anchoring technique, which has the following problems: firstly, resin anchoring agents have poor adaptability to coal mass and attain a poor anchoring effect, because coal mass is soft and loose and may have high deformation; secondly, severe side falling may occur because the anchor bonding force is too low to restrain the coal mass from getting loose and deforming; thirdly, drilling in coal walls may result in hole collapse easily and has a low probability of hole formation, the resin anchoring agent is inconvenient to apply, and the coal dust may be mixed with the anchoring agent and thereby further reduces anchoring effect; fourthly, the roadway tunneling speed is severely limited owing to a large number of process steps; fifthly, the rod body has fixed length, and has poor adaptability to local areas; sixthly, the one-time side support can't be reinforced to work further once it fails; instead, a new support has to be erected again. Consequently, the roadway has to be expanded repeatedly, the engineering workload is increased, and it is difficult to meet the requirements of succession of tunneling and mining for the novel mine; and it is also difficult to meet the requirements of quick tunneling technique that integrates excavation and anchoring.

Common self-drilling and self-anchoring anchor rods are difficult to apply in coal roadways owing to their complex structure, high cost, and long installation time, etc. The Chinese Patent document CN1054433150A has put forward a self-drilling anchor rod that can be mounted quickly for grouting support. However, a great deal of coal dusts produced by rotary drilling of a drill bit at a high speed can't be discharged timely because the coal dust discharge channel is narrow; in addition, the anchor rod has complex structure and high manufacturing cost. The Chinese Patent document CN1548659A has put forward a method for supporting soft soil layer with self-drilling anchor rods. However, that method can't meet the requirements for coal roadway supporting because the anchor rods cannot be pre-tightened until the grout is cured in the subsequent grouting process. The Chinese Patent Document CN100497887C has put forward a casing and expansion shell type self-drilling hollow anchor rod for roof grouting. However, the effect of the expansion shell mechanism is limited by the coal dusts and crushed stones in the cross bores in the sides; in addition, that method is only applicable to roof, and is not effective to prevent side falling.

At present, a resin cartridge anchor supporting technique is used for coal roadway sides. However, the resin anchoring agent has poor adaptability to soft and loose coal body, side falling and hole collapse may occur easily at the coal walls, and the resin cartridge is inconvenient to mount; the one-time side support can't be reinforced to work further once it fails; instead, a new support has to be erected; consequently, the roadway has to be expanded repeatedly, and the engineering workload is increased; in addition, the requirement for the anchorage length of the anchor rods may vary, depending on the site operation conditions of equipment (e.g., roadheader with anchor, etc.) and the local geologic conditions of the roadway, but the anchor rod length and anchorage length can't be adjusted at present; moreover, the roadway tunneling speed is limited by procedures such as drilling, charging, anchor rod erection, and pre-tightening, etc. There is an urgent need for an efficient and simple supporting method for coal roadway side supporting.

III. CONTENTS OF THE INVENTION

Technical Problem: To solve the above-mentioned technical problems, the present invention provides a supporting method of an extensible reaming self-anchoring anchor rod. The extensible reaming self-anchoring anchor rod is simple in structure and convenient to use, the length of it can be adjusted according to the actual requirement, and the anchor rod can be reinforced conveniently if the support fails.

Technical Scheme: To attain the technical object described above, the extensible reaming self-anchoring anchor rod provided in the present invention comprises a simple drill bit, an anchor rod body, and a pre-tightening device;

Wherein, the anchor rod body comprises a plurality of drilling rod sections, a plurality of connecting sleeves, and an extension rod section; the plurality of drilling rod sections are connected with each other via the plurality of connecting sleeves, and are connected at their tail end with the extension rod section via a connecting sleeve; each of the drilling rod section has an axial through-hole inside of it, a big helical structure outside of it, top threads outside of its head end, a hexagonal connecting portion at its tail end, and a plurality of grouting holes communicating with the interior through-holes in its side surface; each of the connecting sleeves has a connecting sleeve through-hole inside of it, a hexahedral connecting portion matching the hexagonal connecting portion of the drilling rod section in the interior at one end, and a threaded connecting portion matching the top threads of the extension rod section in the interior at the other end;

The pre-tightening device comprises a stop-grouting plug, a tray, and a nut that are arranged sequentially on the anchoring threads of the extension rod section.

The simple drill bit is a disposable drill bit made of steel, the strength of the steel exceeds 1.2 times of the strength of the drilled rock mass, and the outer diameter of the simple drill bit is smaller than the outer diameter of the helical rod body by 2 mm-10 mm.

The outer diameter of the connecting sleeve is smaller than the outer diameter of the helical structure, and the connecting sleeve comprises a hexahedral connecting portion, a connecting sleeve through-hole, and a threaded connecting portion.

The length of the plurality of drilling rod sections is 800 mm-1,500 mm, and the length of the extension rod section is 600 mm-1,200 mm.

A supporting method of the above-mentioned reaming self-anchoring anchor rod, comprising the following steps:

a. in the supporting work for roadway tunneling, designing supporting positions in an area where the support is to be extended, assembling a simple drill bit on a first drilling rod section, connecting the hexagonal connecting portion at the tail end of the first drilling rod section directly to the hexagonal connecting sleeve of an onboard or individual jumbolter, starting the jumbolter, and using the simple drill bit driven by the jumbolter to drill and ream a bore in the coal mass in one operation, since the outer diameter of the simple drill bit is smaller than the outer diameter of the big helical rod body, the big helical structure accomplishes secondary reaming and self-anchoring in the drilling process;

b. stopping drilling when only 200 mm tail part of the first drilling rod section is left exposed outside of the coal wall, designing the anchorage length according to the geologic condition, and, if a plurality of drilling rod sections are required, detaching the jumbolter from the tail part of the first drilling rod section, utilizing the hexahedral connecting portion of a connecting sleeve to match the hexagonal connecting portion of the first drilling rod section, connecting a second drilling rod section via the top threads with the threaded connecting portion of the connecting sleeve, mounting the jumbolter on the tail part of the second drilling rod section, and starting the jumbolter to drive the second drilling rod section into the coal wall; repeating the operations for the rest drilling rod sections in the same way;

c. after the mounting of the drilling rod sections, fitting the hexahedral connecting portion of a connecting sleeve with the hexagonal connecting portion at the tail end of the drilling rod section, connecting the threaded connecting portion and the top threads of the extension rod section, mounting a pre-tightening device onto the anchoring threads of the extension rod section, connecting the hexahedral portion at the tail end of the extension rod section to the jumbolter, starting the jumbolter and drilling, and stopping drilling and finishing mounting of the extension rod section when the tray contacts with the coal wall closely; repeating the above steps to accomplish supporting for roadway tunneling;

d. within 24 h-48 h after the supporting is accomplished, utilizing a self-stabilization process of the rock mass to embed the big helical structure of the anchor rod body in the coal mass and couple it with the coal mass, and thereby generating working anchoring force mainly composed of embedding force and friction force; at this point, tightening up the nut of the device fully again, so that the tray squeezes the coal wall and the big helical structure of the rod body interacts with sheet cracks of the coal wall in the radial direction to inhibit crack propagation and development;

e. utilizing the through-hole and the grouting holes in the anchor rod body to grout at 10~30 m distance behind the tunneling face, in case that the roadway has a loose structure or has developed cracks;

f. performing complementary grouting for reinforcement according to the actual condition of strata pressure behaviors if the roadway is disturbed by the mining work after the roadway is put into use.

The big helical structure is arranged along the full length of the drilling rod sections and the extension rod section; the helical direction is right-handed, and the helical angle is 10°-60°; the pitch of the helix is 20 mm-100 mm, the height of the helix is 10 mm-30 mm, and the thickness of the helix is 2 mm-20 mm.

Beneficial effects: With the above-mentioned technical scheme, the method provided in the present invention has the following advantages when compared with the prior art:

(1) Reaming and self-anchoring is realized with the big helical structure of the rod body. In addition, the big helical structure is embedded in the coal mass through a self-stabilization process of the rock mass, working anchoring force is formed from the embedding force generated by a coupling effect between the helical rod body and the coal mass, so as to replace resin anchoring agent, and the adaptability to control of wall deformation of coal roadway is improved obviously.

(2) The construction technology of sides supporting is simplified. The anchor rod has a drill bit, which accomplishes reaming and self-anchoring, and realizes integration of drilling and anchoring; the anchor rod is assembled in advance and can be installed in one operation; thus, procedures such as drilling and charging, etc., are omitted, problems such as drilling failure, hole collapse and blocking, etc. are avoided, and the sides supporting speed can be improved effectively.

(3) The anchor rod can exert a variety of functions against strata pressure behaviors in different phases in the life cycle of the roadway. In the entire process from roadway excavation to roadway service, by means of self-drilling and self-anchoring in the early stage and grouting, extending and anchoring in the late stage, sides deformation and falling can be constrained effectively, integration of drilling and anchoring is realized, and the supporting efficacy is improved significantly.

(4) With the sectional structure, the rod body length and anchorage length are adjustable, sectional extension and anchoring is realized, various problems incurred by fixed anchor rod length are eliminated, the site construction requirements of equipment (such as drilling and anchoring equipment) can be met, and a drawback that the anchor rod length can't be adjusted timely owing to geologic condition change of the roadway is overcome.

(5) Sides falling and serve deformation of loose coal roadway are controlled effectively. The big helical structure can inhibit sheet crack propagation and development in the coal walls in the radial direction, prevent falling of loose body, and can effectively control sides falling of coal wall.

IV. DESCRIPTION OF DRAWINGS

In the figures: 1—simple drill bit; 2—big helical structure; 3—drilling rod section; 4—hexagonal connecting portion; 5—connecting sleeve; 6—extension rod section; 7—grouting hole; 8—stop-grouting plug; 9—tray; 10—nut; 11—top thread; 12—anchoring thread; 13—nut thread; 14—hexagonal portion at the tail end of rod; 15—through-hole; 16—hexahedral connecting portion; 17—connecting sleeve through-hole; 18—threaded connecting portion.

V. EMBODIMENTS

Hereunder the present invention will be further detailed in examples with reference to the accompanying drawings.

Figure 1:
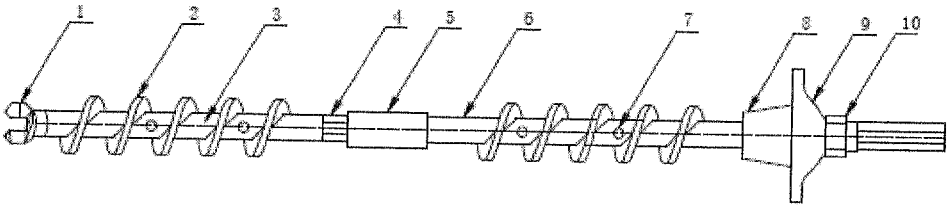
FIG. 1 is a schematic structural diagram of the anchor rod in the present invention.
Figure 2:
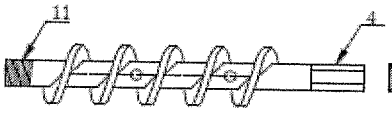
FIG. 2 is a schematic diagram of the drilling rod section in the present invention.
Figure 3:
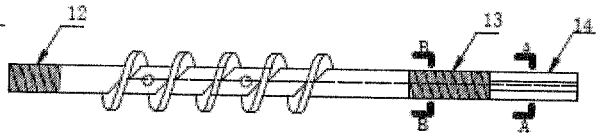
FIG. 3 is a schematic diagram of the extension rod section in the present invention.
Figure 4:
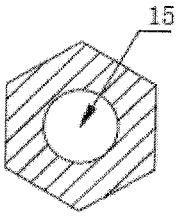
FIG. 4 is a sectional view along A-A line of the extension rod section in the present invention.
Figure 5:
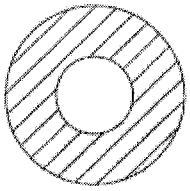
FIG. 5 is a sectional view along B-B line of the extension rod section in the present invention.
Figure 6:
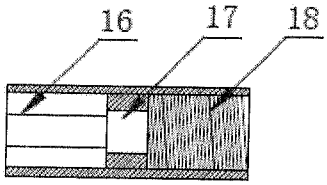
FIG. 6 is a longitudinal sectional view of the connecting sleeve in the present invention.

As shown in FIGS. 1, 2 and 3, the extensible reaming self-anchoring anchor rod provided in the present invention comprises a simple drill bit 1, an anchor rod body, and a pre-tightening device; the simple drill bit 1 is a disposable drill bit made of steel, the strength of the steel exceeds 1.2 times of the strength of the drilled rock mass, and the outer diameter of the simple drill bit is smaller than the outer diameter of the helical rod body by 2 mm-10 mm, wherein the anchor rod body comprises a plurality of drilling rod sections 3, a plurality of connecting sleeves 5, and an extension rod section 6; the length of the plurality of drilling rod sections 3 is 800 mm-1,500 mm, and the length of the extension rod section is 600 mm-1,200 mm; the plurality of drilling rod sections 3 are connected with each other via the plurality of connecting sleeves 5, and are connected at their tail end with the extension rod section 6 via a connecting sleeve 5; each of the drilling rod section 3 has an axial through-hole inside of it, a big helical structure 2 outside of it, top threads 11 outside of its head end, a hexagonal connecting portion 4 at its tail end, and a plurality of grouting holes 7 communicating with the interior through-holes in its side surface; each of the connecting sleeves 5 has a connecting sleeve through-hole 17 inside of it, and a hexahedral connecting portion 16 matching the hexagonal connecting portion 4 of the drilling rod section 3 in the interior at one end, as shown in FIG. 4;

As shown in FIG. 5, a threaded connecting portion 18 matching the top threads 12 of the extension rod section 6 is arranged in the interior at the other end of the connecting sleeves 5; wherein, the through-hole 15 is a hollow cavity of the rod body and is used to inject water for wet boring in the construction process; at any location where the strata pressure behaviors are obvious, the through-hole 15 is used to grout for reinforcement;

As shown in FIG. 6, the outer diameter of the connecting sleeve 5 is smaller than the outer diameter of the helical structure, and the connecting sleeve comprises a hexahedral connecting portion 16, a connecting sleeve through-hole 17, and a threaded connecting portion 18. The hexahedral connecting portion (16) is quickly connected with the hexagonal connecting portion (4) of the drilling rod section, and the threaded connecting portion (18) is connected with the top threads of the extension rod section. Every two rod sections communicate with each other through the through-hole (17), to facilitate wet boring and grouting in later stage. The threads of the drilling rod sections and the extension rod section are in the same specification. The pre-tightening device comprises a stop-grouting plug 8, a tray 9, and a nut 10 that are arranged sequentially on the anchoring threads 12 of the extension rod section.

The out diameter of the simple drill bit 1 is greater than the diameter of the anchor rod body by 3~8 mm, the simple drill bit 1 has an opening connected with the anchor rod body, a plurality of sharp knives that protrude and are inclined to the center are arranged around the opening, the top of each sharp knife is at 3 mm-5 mm from the center of the drill bit, spiral grooves configured to discharge the dust produced during drilling from the drill bit are arranged on the side surface of the simple drill bit 1, and the spiral grooves has a width of 5 mm-8 mm and a depth of 3 mm-5 mm. A plurality of pawls are arranged at the clearance between the grooves on the side surface of the simple drill bit 1, and each pawl comprises a groove cavity, a circular shaft, a high-strength baffle plate, and a strong spring, wherein, the groove cavity provides a space for rotation of the high-strength baffle plate, the bottom side of the groove cavity is movably connected with the high-strength baffle plate via the circular shaft, the strong spring is arranged between the high-strength baffle plate and the bottom of the groove cavity, the high-strength baffle plate is ejected by the strong spring and can rotate within the groove cavity via the circular shaft.

A supporting method of the above-mentioned reaming self-anchoring anchor rod, comprising the following steps:

a. in the supporting work for roadway tunneling, designing supporting positions in an area where the support is to be extended, assembling a simple drill bit 1 on a first drilling rod section 3, connecting the hexagonal connecting portion 4 at the tail end of the first drilling rod section 3 directly to the hexagonal connecting sleeve of an onboard or individual jumbolter, starting the jumbolter, and using the simple drill bit 1 driven by the jumbolter to drill and ream a bore in the coal mass in one operation, since the outer diameter of the simple drill bit 1 is smaller than the outer diameter of the big helical rod body, the big helical structure 2 accomplishes secondary reaming and self-anchoring in the drilling process;

b. stopping drilling when only 200 mm tail part of the first drilling rod section 3 is left exposed outside of the coal wall, designing the anchorage length according to the geologic condition, and, if a plurality of drilling rod sections 3 are required, detaching the jumbolter from the tail part of the first drilling rod section 3, utilizing the hexahedral connecting portion 15 of a connecting sleeve 5 to match the hexagonal connecting portion 4 of the first drilling rod section 3, connecting a second drilling rod section 3 via the top threads 11 with the threaded connecting portion 18 of the connecting sleeve 5, mounting the jumbolter on the tail part of the second drilling rod section 3, and starting the jumbolter to drive the second drilling rod section into the coal wall; repeating the operations for the rest drilling rod sections 3 in the same way;

c. after the mounting of the drilling rod sections, fitting the hexahedral connecting portion 16 of a connecting sleeve 5 with the hexagonal connecting portion 4 at the tail end of the drilling rod section 3, connecting the threaded connecting portion 18 and the top threads 12 of the extension rod section 6, mounting a pre-tightening device onto the anchoring threads of the extension rod section 6, connecting the hexahedral portion 14 at the tail end of the extension rod section 6 to the jumbolter, starting the jumbolter and drilling, and stopping drilling and finishing mounting of the extension rod section 6 when the tray 9 contacts with the coal wall closely; repeating the above steps to accomplish supporting for roadway tunneling;

d. within 24 h-48 h after the supporting is accomplished, utilizing a self-stabilization process of the rock mass to embed the big helical structure 2 of the anchor rod body in the coal mass and couple it with the coal mass, and thereby generating working anchoring force mainly composed of embedding force and friction force; at this point, tightening up the nut 10 of the device fully again, so that the tray 9 squeezes the coal wall and the big helical structure of the rod body interacts with sheet cracks of the coal wall in the radial direction to inhibit crack propagation and development;

e. utilizing the through-hole 15 and the grouting holes 7 in the anchor rod body to grout at 10~30 m distance behind the tunneling face, in case that the roadway has a loose structure or has developed cracks;

f. performing complementary grouting for reinforcement according to the actual condition of strata pressure behaviors if the roadway is disturbed by the mining work after the roadway is put into use.

The big helical structure 2 is arranged along the full length of the drilling rod sections 3 and the extension rod section 6; the helical direction is right-handed, and the helical angle is 10°-60°; the pitch of the helix is 20 mm-100 mm, the height of the helix is 10 mm-30 mm, and the thickness of the helix is 2 mm-20 mm.

The invention claimed is:

1. A method for installing an extensible reaming self-anchoring anchor rod in a coal mass, wherein said extensible reaming self-anchoring anchor rod, comprises a simple drill bit, an anchor rod body, and a pre-tightening device;

wherein the anchor rod body comprises a plurality of hexagonal drilling rod sections, a plurality of connecting sleeves having hexagonal connecting sections, and an extension rod section;

wherein the plurality of hexagonal drilling rod sections are connected with each other via the plurality of hexagonal connecting sleeves, and are connected at their tail end with the extension rod section via a connecting sleeve;

wherein each of the drilling rod sections has a first outer diameter and an axial through-hole inside of the drilling rod section, a helical structure having a second outer diameter greater than the first outer diameter outside of the drilling rod section, top threads outside of the rod section head end, a hexagonal connecting portion at a tail end or the drilling rod section, and a plurality of grouting holes communicating with the interior through-holes in a side surface of the rod section;

wherein each of the connecting sleeves has a connecting sleeve through-hole inside of it, a hexahedral connecting portion matching the hexagonal connecting portion of the drilling rod section in the interior at one end, and a threaded connecting portion matching the top threads of the extension rod section in the interior at the other end; and wherein the pre-tightening device comprises a stop-grouting plug, a tray, and a nut that are arranged sequentially on the anchoring threads of the extension rod section;

said method comprising the following steps:

a. assembling a drill bit on a first drilling rod section;

b. connecting the hexagonal connecting portion at the tail end of the first drilling rod section to the hexagonal connecting sleeve of an onboard or individual jumbolter;

c. starting the jumbolter and using the drill bit driven by the jumbolter to drill and ream a bore in a wall of the coal mass one operation, whereupon due to the outer diameter of the drill bit being smaller than the outer diameter of the helical rod body, the helical structure accomplishes secondary reaming and self-anchoring in the coal mass;

d. discontinuing drilling leaving a tail part of the first drilling rod section exposed outside of the coal wall, and, optionally detaching the jumbolter from the tail part of the first drilling rod section;

e. connecting a second extension drilling rod section to the first drilling read section via the top threads with the threaded connecting portion of the connecting sleeve, mounting the jumbolter on the tail part of the second drilling section, and using the jumbolter to drive the second drilling rod section into the wall of the coal mass;

f. repeating steps d. and e.;

g. mounting a pre-tightening device onto the anchoring threads of the extension rod section, connecting the hexahedral portion at the tail end of the extension rod section to the jumbolter, h. starting the jumbolter and drilling, and discontinuing drilling and finishing mounting of the extension rod section when the tray contacts with the wall of the coal mass;

i. repeating steps d to h to achieve desired anchor depth;

j. removing the jumbolter and tightening a nut on the tail end of the anchor to squeeze together the coal wall and the rod body in the radial direction to inhibit crack propagation and development in the wall of the coal mass;

k. utilizing the through-hole and the grouting holes in the anchor rod body to inject grout behind the face of the wall of the coal mass; and optionally injecting additional grout as necessary for reinforcement.

2. The method according to claim 1, wherein, the drill bit is a disposable drill bit made of steel, the harness of the steel exceeds at least 1.2 times of the hardness of the drilled coal mass, and the outer diameter of the drill bit is smaller than the outer diameter of the helical rod body by 2 mm-10 mm.

3. The method according to claim 1, wherein, the outer diameter of the connecting sleeve is smaller than the outer diameter of the helical structure, and the connecting sleeve comprises a hexahedral connecting portion, a connecting sleeve through-hole, and a threaded connecting portion.

4. The method according to claim 1, wherein, the length of the plurality of drilling rod sections is 800 mm-1,500 mm, and the length of the extension rod sections is 600 mm-1,200 mm.

5. The method according to claim 1, wherein the helical drilling rod has a right handed helical direction.

6. The method according to claim 1, wherein the helical drilling rod has a helical angle of 10°-60°.

7. The method of claim 1, wherein the helical drilling rod has a helical pitch of 20 mm 100 mm.

8. The method of claim 1, wherein the helical drilling rod has a helical height of 10 mm-30 mm.

9. The method of claim 1, wherein the helical drilling rod has a helical thickness of 2 mm 20 mm.

* * * * *